US006913087B1

(12) United States Patent
Brotto et al.

(10) Patent No.: US 6,913,087 B1
(45) Date of Patent: Jul. 5, 2005

(54) SYSTEM AND METHOD FOR COMMUNICATING OVER POWER TERMINALS IN DC TOOLS

(75) Inventors: Daniele C. Brotto, Baltimore, MD (US); Michael Kenneth Forster, White Hall, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/812,521

(22) Filed: Mar. 30, 2004

Related U.S. Application Data

(63) Continuation of application No. 10/768,947, filed on Jan. 30, 2004, now abandoned.

(51) Int. Cl.[7] ..... B25F 5/00

(52) U.S. Cl. ..... 173/1; 173/2; 173/176; 173/217; 173/171

(58) Field of Search ..... 173/1, 2, 4, 176, 173/171, 217; 310/47, 50; 318/490, 680, 318/434, 571; 340/680; 320/106, 127, 107, 320/110; 365/226

(56) References Cited

U.S. PATENT DOCUMENTS

| | | | | |
|---|---|---|---|---|
| 4,206,444 A | | 6/1980 | Ferlan | 340/3.21 |
| 4,771,399 A | | 9/1988 | Snowden et al. | |
| 5,257,199 A | | 10/1993 | Tsujino et al. | 700/160 |
| 5,289,885 A | * | 3/1994 | Sakoh | 173/2 |
| 5,360,967 A | | 11/1994 | Perkin et al. | 235/375 |
| 5,416,627 A | | 5/1995 | Wilmoth | 398/129 |
| 5,560,437 A | | 10/1996 | Dickel et al. | 175/40 |
| 5,734,254 A | * | 3/1998 | Stephens | 320/106 |
| 5,898,379 A | | 4/1999 | Vanbergeijk | 340/680 |
| 5,903,462 A | | 5/1999 | Wagner et al. | 700/168 |
| 5,945,806 A | | 8/1999 | Faulk | 320/127 |
| 5,990,659 A | | 11/1999 | Frännhagen | |
| 6,002,918 A | | 12/1999 | Heiman et al. | 340/7.38 |
| 6,005,489 A | * | 12/1999 | Siegle et al. | 340/825.69 |
| 6,191,554 B1 | * | 2/2001 | Nakane et al. | 320/114 |

(Continued)

FOREIGN PATENT DOCUMENTS

DE 42 25 534 A1 2/1992

(Continued)

*Primary Examiner*—Scott A. Smith
(74) *Attorney, Agent, or Firm*—Harness, Dickey & Pierce, P.L.C.

(57) ABSTRACT

A system and method for unidirectionally or bi-directionally communicating information and data to and from an electronic module housed within a cordless power tool, over power terminals of the cordless power tool, while a battery pack of the tool is removed from the tool. A data transfer device is connected to at least one power terminal of the tool in place of the battery pack. The power terminal is also used for electrically connecting the battery pack to the tool during normal operation of the tool. A voltage supplied by the data transfer device to the tool is sequentially varied between a first level and a second level, in accordance with a predetermined communications protocol, to transmit data from electronic module of the tool to the data transfer device. A voltage signal applied to the electronic module of the tool is sequentially shifted between a first voltage and a second voltage to transmit data from the data transfer device to the tool. Thus, data can be transmitted between the tool and the data transfer device without requiring disassembly of the tool.

59 Claims, 5 Drawing Sheets

U.S. PATENT DOCUMENTS

| | | | | |
|---|---|---|---|---|
| 6,308,787 | B1 | 10/2001 | Alft | 175/48 |
| 6,331,744 | B1 | 12/2001 | Chen et al. | 310/171 |
| 6,336,031 | B1 | 1/2002 | Schyndel | 455/41.2 |
| 6,349,266 | B1 * | 2/2002 | Lysaght et al. | 702/41 |
| 6,380,852 | B1 | 4/2002 | Hartman et al. | 340/521 |
| 6,430,463 | B1 * | 8/2002 | Lysaght | 700/168 |
| 6,607,041 | B2 * | 8/2003 | Suzuki et al. | 173/4 |
| 6,668,212 | B2 * | 12/2003 | Colangelo et al. | 700/275 |
| 6,738,685 | B2 * | 5/2004 | Kimmel et al. | 700/168 |
| 2001/0015696 | A1 | 8/2001 | Ludwig | |

FOREIGN PATENT DOCUMENTS

| | | | |
|---|---|---|---|
| DE | 198 17 273 | A1 | 10/1999 |
| DE | 199 04 776 | A1 | 8/2000 |
| DE | 100 15 398 | A1 | 10/2001 |
| EP | 1 008 423 | A2 | 6/2000 |

* cited by examiner

SYSTEM AND METHOD FOR COMMUNICATING OVER POWER TERMINALS IN DC TOOLS

CROSS-REFERENCE TO RELATED APPLICATIONS

This application is a continuation of application Ser. No. 10/768,947, filed Jan. 30, 2004, now abandoned. The entire contents of the aforementioned patent application are incorporated herein by reference.

FIELD OF THE INVENTION

The present invention relates to cordless power tools. More specifically, the invention relates to communicating information between the power tool and a data transfer device via the power terminals of the tool. The power terminals are the same power terminals used for connecting to a tool power supply, i.e. a portable battery pack, during operation of the tool.

BACKGROUND OF THE INVENTION

Contemporary cordless power tools are becoming more common place in homes and on commercial construction job sites. The evolution of cordless power tools has resulted in a large variety of power tools being manufactured in cordless versions. For example, power tools such as nailers, drills, screwdrivers, circular saws, reciprocating saws, scroll saws and sanders are now commonly manufactured in a cordless version. Along with an increase in the type of cordless power tools has come an increase in technical complexity of the cordless power tools. Present day electronic components, such as microcontrollers and memory modules, are sufficiently small such that they can be easily mounted within the housings of many cordless power tools. Some known power tools incorporate such electronic components to collect and store data relating to tool usage and other pertinent information concerning the operation of the tool. Additionally, such electronic components are utilized to store algorithms and programs used to control the operation of the tool.

Known methods of communicating with cordless power tools to extract operational data, input control algorithms, update control programs and/or update control coefficients are generally labor intensive, cumbersome, costly and can reduce the reliability of the tool. For example, the tool may have to be disassembled to gain access to the electronic component. In other instances, additional electrical or optical communication terminals or ports may have to be added to the tool to allow communication with the electronic component. It would therefore be highly desirable to provide a means for communicating with data storage modules and/or control modules within a cordless power tool without disassembling the tool or including additional communication ports.

SUMMARY OF THE INVENTION

The present invention is directed to a system and method for communicating information and data over power terminals of a cordless power tool.

In one preferred implementation, a method is provided that includes connecting a host device to at least one power terminal of the tool. The power terminal is also used for connecting a power supply to the tool during operation of the tool. The method additionally includes varying a voltage supplied by the host device to the tool between a first level and a second level to transmit data from the tool to the host device. The method further includes shifting a voltage signal to a microcontroller of the tool between a first voltage and a second voltage to transmit data from the host device to the tool.

In another preferred embodiment a system is provided that includes a host device adapted to connect to at least one power terminal of the tool, wherein the power terminal also connects to a tool power supply during operation of the tool. The system additionally includes a first communications circuit included in the tool. The first communications circuit is adapted to vary a voltage supplied by the host device to the tool between a first level and a second level to thereby transmit data from the tool to the host device. The system further includes a second communications circuit included in the host device. The second communications circuit is adapted to shift a voltage signal to a microcontroller of the tool between a first level and a second level to thereby transmit data from the host device to the tool.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application or uses.

Figure 1:
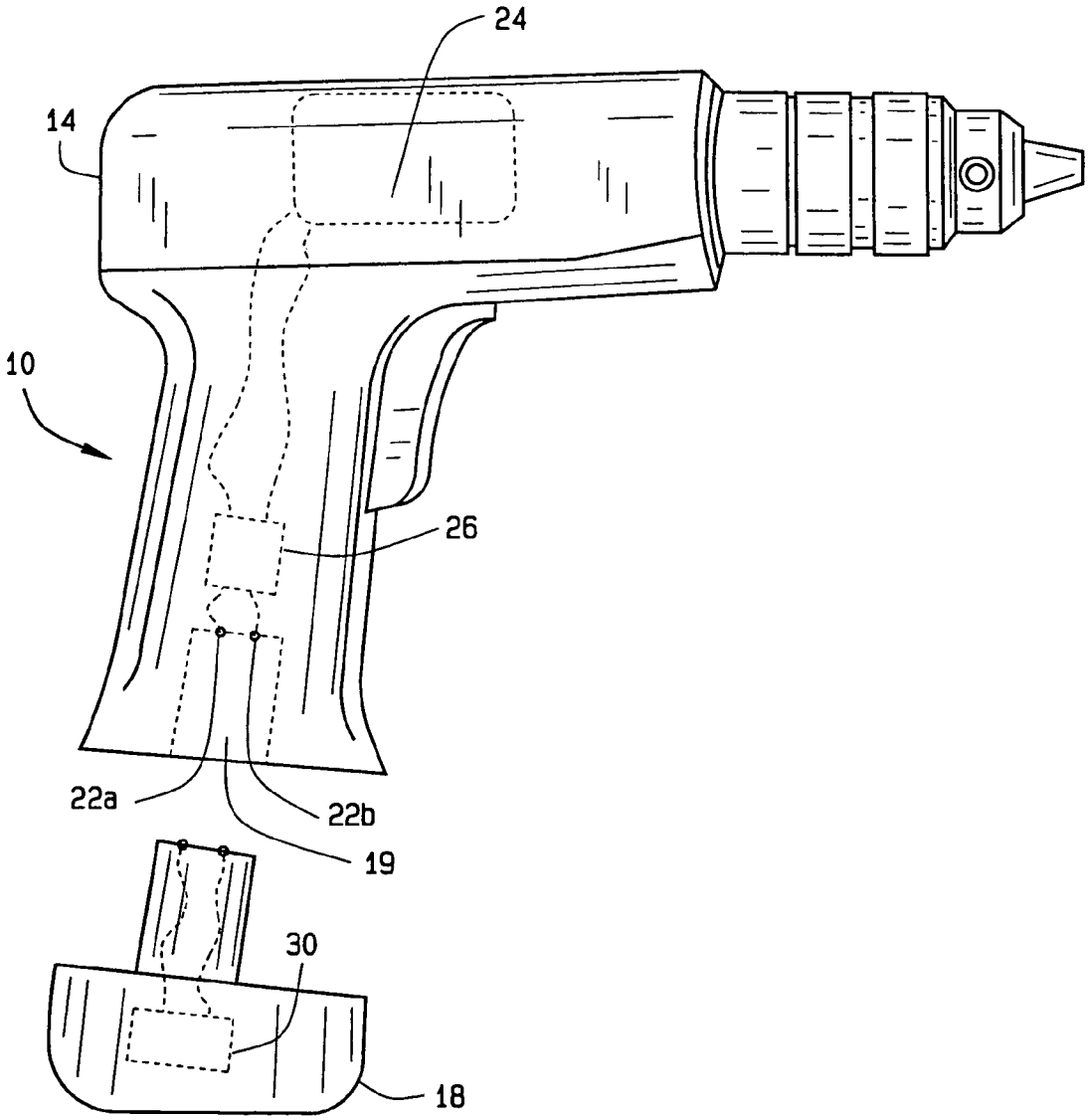
FIG. 1 is a simplified block diagram of a system for communicating data to and from a cordless power tool, in accordance with a preferred embodiment of the present invention.

FIG. 1 is a simplified block diagram of a system 10 for communicating data to and/or from a cordless power tool 14, in accordance with a preferred embodiment of the present invention. It will be appreciated that although the cordless tool 14 is shown in FIG. 1 as a cordless drill, the power tool 14 can be any cordless tool such as a nailer, drill, screwdriver, circular saw, reciprocating saw, scroll saw or sander, etc. The system 10 includes a data transfer device 18, also referred to as a host device that is adapted to connect to power terminals 22*a* and 22*b* of the power tool 14 to communicate with the power tool 14 when power tool 14 is in a communications mode. The power terminals 22*a* and 22*b* are also used for connecting a tool power supply, such as a removable, portable battery pack, to the tool 14 to provide power to operate a motor 24 of the tool 14 during an operation mode.

In a preferred embodiment the data transfer device 18 is substantially similarly shaped to the power supply, e.g. the removable, portable battery pack, such that the data transfer device 18 is connected to the power tool 14 in the same manner as the power supply. For example, as shown in FIG. 1, the data transfer device 18 is shaped substantially similar to a removable, portable battery pack that has been removed from a battery pack receptacle 19 of the power tool 14. Therefore, the data transfer device 18 is connected to the power tool 14 in the same manner as the battery pack is connected to the power tool 14 when the power tool 14 is in an operation mode. Thus, the data transfer device 18 is quickly and easily interchangeable with the battery pack. In another preferred embodiment, the data transfer device 18 is a removable, portable battery pack that includes a communications circuit described below.

Figure 1A:
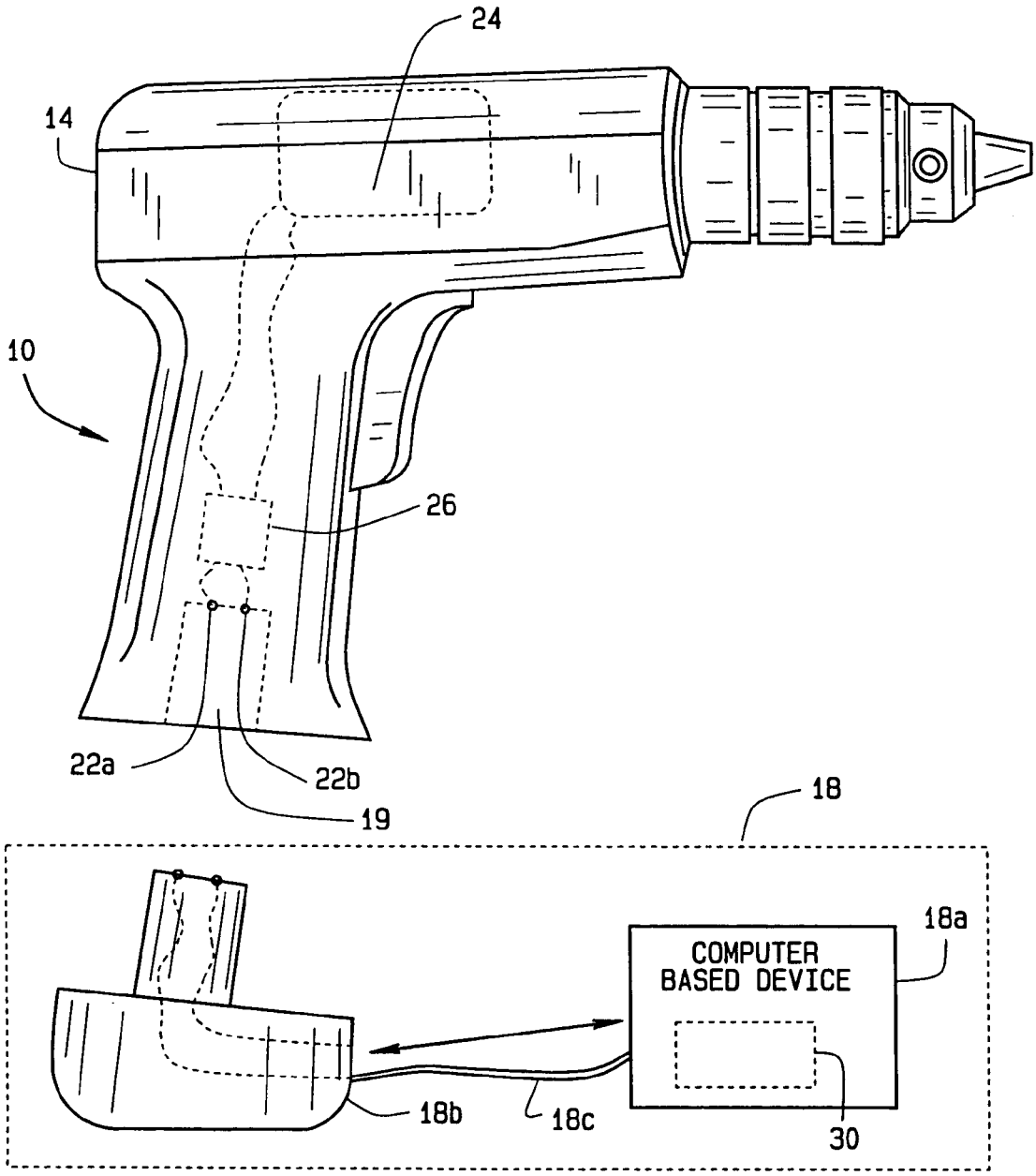
FIG. 1A is a simplified block diagram of an alternate preferred embodiment of the system shown in FIG. 1.

Referring to FIG. 1A, in an alternate preferred embodiment, a data transfer device 18' includes a computer based device 18*a*, such as a laptop or hand held computer, and a connector 18*b*. The computer based device 18*a* is communicatively linked to the connector 18*b* and includes a communications circuit described below. The connector 18*b* can be communicatively linked to the computer based device 18*a* via a suitable interface cable 18*c* or even by a wireless connection. The connector 18*b* is shaped similar to the removable, portable battery pack that has been removed from the power tool 14. The data transfer device 18 is connected to the power tool 14 by inserting the connector 18*b* into the power tool 14 in the same manner as the battery pack. Thus, the data transfer device 18' accomplishes the interfacing with the tool 14 with the connector 18*b* and interface cable 18*c* functioning essentially just as the interfacing components of the device 18 shown in FIG. 1. For convenience the following detailed description will be directed to use of the data transfer device 18.

Referring further to FIG. 1, the system 10 includes a first communications circuit 26 that is housed inside the power tool 14. The first communications circuit 26 is adapted to communicate with a second communications circuit 30 included in the data transfer device 18, via the power terminals 22*a* and 22*b* of the power tool 14. More specifically, power terminal 22*a* serves a dual purpose. Power terminal 22*a* is utilized to provide power to the power tool 14 and the first communications circuit 26, and utilized to transmit data between the first and second communications circuits 26 and 30.

In a preferred embodiment, the system 10 is adapted to provide bi-directional communication between the first communications circuit 26 and the second communications circuit 30. For example, data and information, such as operational parameters and tool operation history information, can be downloaded, i.e. transmitted, from the first communications circuit 26 to the second communications circuit 30. Likewise, data and information, such as algorithms, programs, algorithm and/or program coefficients and operational parameters can be uploaded, i.e. transmitted, from the second communications circuit 30 to the first communications circuit 26. Alternatively, the system 10 can be configured to provide only unidirectional communication between the first communications circuit 26 and the second communications circuit 30. For example, in one instance, system 10 is adapted to only transmit data and information from the first communications circuit 26 to the second communications circuit 30. In another instance, system 10 is only adapted to transmit data and information from the second communications circuit 30 to the first communications circuit 26.

Figure 2:
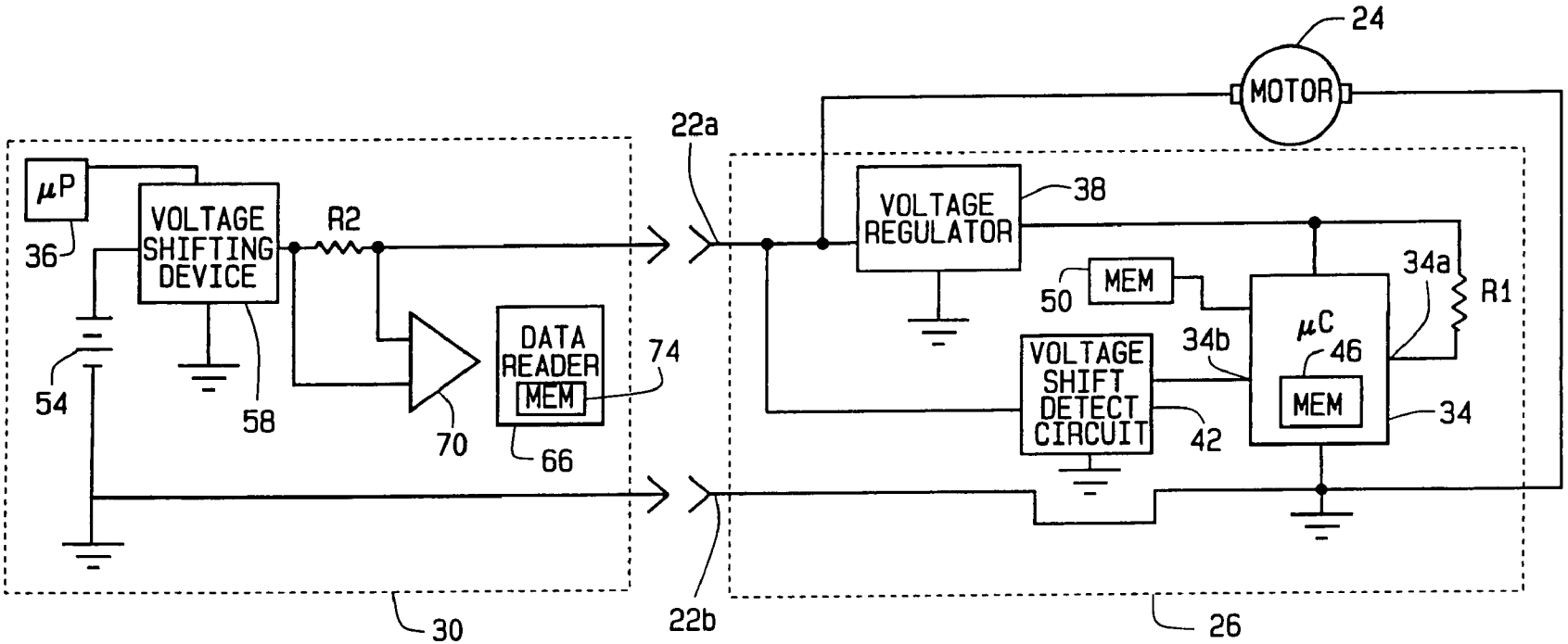
FIG. 2 is a simplified block diagram of a first communications circuit and a second communications circuit shown in FIG. 1.

FIG. 2 is a simplified block diagram of the first and second communications circuits 26 and 30, shown in FIG. 1. The first communications circuit 26 includes a microcontroller 34 that controls the communications between the data transfer device 18 and the power tool 14. More specifically, the microcontroller 34 works in conjunction with a controller, preferably a microprocessor 36, included in the second communications circuit 30, to control communications between the first and second communications circuits 26 and 30. Alternatively, the microprocessor 36 could be a device external to the second communications circuit 30, for example a laptop or handheld computer.

Additionally, the first communications circuit 26 includes at least one voltage regulator 38 and a voltage shift detection circuit 42. The voltage regulator 38 maintains a voltage output supplied to the microcontroller 34 at a level suitable to enable operation of the microcontroller 34. In a preferred embodiment, the first communications circuit 26 further includes a first resistor R1 connected between an output of the voltage regulator 38 and a port 34*a* of the microcontroller 34. The impedance at the port 34*a* is defaulted high such that current will not flow through the first resistor R1 unless the microcontroller 34 pulls the signal at port 34*a* low. When the signal at 34*a* is low, current will flow through the first resistor R1. Alternatively, R1 can be replaced with any electrical component suitable to control the flow of current in first communication circuit 26 in accordance with the impedance level of the port 34*a*. For example, R1 could be replaced with a LED, an inductor or a transistor. Therefore, although the operation of the first communications circuit 26 will be described in terms using the first resistor R1, it should be understood that the first resistor R1 can be replaced with any other electrical component suitable to allow the microcontroller 34 to control the level of current flowing through connector 22*a* by switching the impedance at port 34*a* and remain within the scope of the invention.

The microcontroller 34 includes an electronic memory 46 suitable for storing information, data and programming relating to all operational aspects of the power tool 14. For example, the microcontroller memory 46 can store data to be transmitted to the second communications circuit 30. Similarly, data transmitted from the second communications circuit 30 can be stored in the microcontroller memory 46. In another preferred embodiment, the first communications circuit 26 includes a memory device 50 that is external to the microcontroller 34. The memory device 50 is utilized by the system 10 in substantially the same manner as microcontroller memory 46. Although the system 10 will be described herein referencing the microcontroller memory 46, it will be appreciated that microcontroller memory 46 and memory device 50 are interchangeable with regard to the operation of the system 10. In yet another preferred embodiment, the microcontroller 34 controls operation of the tool 14 in addition to controlling communications between the first and second communications circuits 26 and 30.

The second communications circuit 30 includes a circuit power source 54, such as a battery, and a voltage shifting device, or circuit, 58. Preferably, the power source 54 is internal to the data transfer device 18 such that no power source external to the data transfer device 18 is needed for operation of the system 10. However, the power source 54 could be external to the data transfer device 18 and remain within the scope of the invention. In the case where the data transfer device 18 is a removable, portable battery pack that includes the second communications circuit 30, the battery pack itself is the power source 54. The voltage shifting device 58 regulates the voltage supplied by the circuit power source 54. Additionally, the voltage shifting device 58 is adapted to shift the regulated voltage between a first voltage level and a second voltage level. The voltage shifting device 58 is controlled by the microprocessor 36. The microprocessor 36 controls the voltage shifting device 58 such that the output voltage of the voltage shifting device 58 is substantially constant when the first communications circuit 26 is transmitting data to the second communications circuit 30. The microprocessor 36 further controls the voltage shifting device 58 such that the output voltage of the voltage shifting device 58 is varied between the first voltage level and the second voltage level when the second communications circuit 30 is transmitting data to the first communications circuit 26.

The voltage shifting device 58 preferably includes two voltage regulators and a voltage switching device such as, for example, a triac, a field effect transistor (FET), an insulated gate bipolar transistor (IGBT) or a silicone-controlled rectifier (SCR). Alternatively, the voltage shifting device 58 can be any device suitable for outputting a voltage that is shifted between two voltage levels. The voltage output by the voltage shifting device 58 can be regulated or unregulated.

The second communications circuit 30 additionally includes a second resistor R2, a data reader 66 and a differential circuit 70, for example a differential amplifier. In a preferred embodiment, the data reader 66 is external to the microprocessor 36, as shown in FIG. 2. In an alternative preferred embodiment, the data reader 66 is incorporated with, i.e. internal to, the microprocessor 36. The differential circuit 70 can be any circuit or device suitable to produce an output signal representative of a voltage across the second resistor R2 and output a digital signal to the data reader 66. More specifically, the differential circuit 70 outputs a signal that varies in accordance with voltage changes across the second resistor R2. For example, the differential circuit 70 can be an operational amplifier, a differential comparator or a signal conditioning device. The output of differential circuit 70 is preferably a digital output, but can also be an analog signal and remain within the scope of the invention. In an alternate preferred embodiment, the data reader 66 is external to the second communications circuit 30. For example, the data reader 66 could be a laptop computer or hand held computer connected to the output of the differential circuit 70.

To initiate the communications mode of the tool 14, the tool power supply, e.g. a portable battery pack, is disconnected from the power terminals 22*a* and 22*b* and removed from the tool 14. The data transfer device 18 is then connected to the tool 14 at the power terminals 22*a* and 22*b*. As described above, the data transfer device 18, or alternatively the connector 18*b* linked to the data transfer device 18, is shaped similar to the tool power supply removed from the tool 14 so that it can be readily coupled to the battery pack receptacle 19. Thus, the data transfer device 18, or alternatively the connector 18*b*, is inserted into the receptacle 19 of the tool 14 and connected to the power terminals 22*a* and 22*b* in the same manner as the tool power supply. When the data transfer device 18, or the connector 18*b*, is connected to the power terminals 22*a* and 22*b*, the circuit power source 54 provides power to the first communications circuit 26.

The voltage shifting device 58 and the second resistor R2 control the voltage output from the second communications circuit 30 to the first communications circuit 26. Accordingly, the current output from the second communications circuit 30 will be affected in accordance with changes in the voltage output, as controlled by the voltage shifting device 58 and the second resistor R2. Alternatively, the current output from the second communications circuit 30 could be controlled to thereby affect a change in voltage output by the second communications circuit 30. In a preferred form, the voltage shifting device 58 and the second resistor R2 control the voltage and/or current such that power provided by the second communications circuit 30 is sufficient to enable operation of the microcontroller 34. Additionally, the voltage regulator 38 regulates the voltage supplied to the microcontroller 34. The power provided by the second communications circuit 30 is sufficient to enable operation of the microcontroller 34, but insufficient to drive the motor 24. Therefore, the motor 24 will not operate when the tool 14 is in the communications mode with the data transfer device 18 coupled to the tool 14. Alternatively, the second communications circuit 30 can provide sufficient power to power both the microcontroller 34 and the motor 24. In this implementation, the microcontroller 34 is programmed to suspend data transmission if the tool 14 is activated while in the communications mode.

Once operation of the microcontroller 34 is enabled, the microcontroller 34 can either transmit data to the data reader 66, receive data transmitted by the second communications circuit 30 or both. Preferably, the system 10 is adapted for bi-directional communication. To transmit data to the data reader 66 in this embodiment, the second communications circuit 30 queries the microcontroller 34 for data. The microcontroller 34 then begins to sequentially pulse the port 34*a* between a high impedance and a low impedance in a predetermined data communications pattern. For example, the pulsing pattern of the port 34*a* may have a serial ASCII data form pulsed at a specific baud rate. The pulsing pattern comprises data to be transmitted from the microcontroller 34 to the data reader 66. The sequential pulsing of the port 34*a* causes a voltage across the first resistor R1 to shift between a first voltage and a second voltage in the same sequential pattern. For example, the voltage across the first resistor R1 shifts between 0 volts and 5 volts in the same sequential pattern as the port 34*a* is pulsed. The shifting of the voltage across the first resistor R1 causes the current flowing from the second communications circuit 30 to the first communications circuit 26 to shift between a first level and a second level. Accordingly, the shifting current from the second communications circuit 30 to the first communications circuit 26 causes the voltage supplied by the second communications circuit 30 to the first communications circuit 26 to vary between a first level and a second level.

More specifically, the current drawn from the voltage shifting device 58 and flowing through the second resistor R2 will shift between the first level and the second level in the same sequential pattern as the pulsing of the port 34*a*. The changing current flowing through the second resistor R2 in turn causes the voltage across the second resistor R2 to sequentially alternate between a first voltage and a second voltage. The sequentially alternating voltage across the second resistor R2 will also have the same sequential pattern as the pulsing of the port 34*a*. The differential circuit 70 resolves the varying voltage across the second resistor R2 into digital signals that correlate to the switching of the voltage across the second resistor R2 between the first and second voltage levels. The digital signals are representative of the data being transmitted by the microcontroller 34.

For example, when port 34*a* is at high impedance, there will be substantially no current flowing through the first resistor R1 thereby causing the current flowing through the second resistor R2 to produce the first voltage across the second resistor R2. Accordingly, the differential circuit 70 outputs a digital signal that corresponds to the first voltage across the second resistor R2, e.g a digital low signal. Subsequently, when the port 34*a* is pulled to low impedance, current will flow through the first resistor R1 that results in a change in the current flowing through the second resistor R2. Accordingly, the current through the second resistor R2 causes the voltage across the second resistor R2 to change to the second voltage. The differential circuit 70 senses the change in voltage drop across the second resistor R2 and outputs a signal corresponding to the second voltage, e.g. a digital high level signal. Therefore, as the voltage across the second resistor R2 is sequentially alternated between the first and second voltages, in accordance with the sequential switching of impedance at the port 34*a*, the output signal of the differential circuit 70 sequentially switches between digital high and low signals. Thus, the digital output of the differential circuit 70 represents a serial stream of data being transferred from the tool 14 to the data transfer device 18.

The digital signals from the differential circuit 70 are then input to the data reader 66. The data reader 66 interprets the digital signals as a serial data stream and stores the data in a memory device 74. In one preferred embodiment the memory device 74 is included in the data reader 66. Alternatively, the memory device 74 can be external to data reader 66. Furthermore, if the data reader 66 is an external computer device, such as a laptop, the external computer device will preferably include memory for storing the data transmitted from the microcontroller 34.

To transmit data from the data transfer device 18 to the tool 14, the second communications circuit 30 signals the microcontroller 34 that data is to be transmitted from the second communications circuit 30 to the microcontroller 34. The microprocessor 36 then commands the voltage shifting device 58 to sequentially shift the voltage output by the voltage shifting device 58 between a first voltage level and a second voltage level in accordance with a predetermined data transmission pattern, thereby representing the data to be transmitted. For the purposes of clarity and convenience the first and second voltage output levels of the voltage shifting device 58 will be respectively referred to herein to as V1 and V2. The voltage shifting pattern may comprise a serial ASCII data form shifted at a specific baud rate or any other data transfer format.

The shifting voltage output by the voltage shifting device 58 drives the voltage regulator 38 to provide power to the microcontroller 34. Thus, the voltage regulator 38 has the ability to accept a range of input voltages. The microcontroller 34 is fully enabled when the output voltage of the voltage shifting device 58 is at V1 or V2, or between V1 and V2. The first output voltage V1 is sufficient to power-up, i.e. enable, the microcontroller 34 but insufficient to enable operation of the motor 24. Likewise, the second output voltage V2 is sufficient to power-up the microcontroller 34 but insufficient to enable operation of the motor 24. The sequentially shifting voltage output by the voltage shifting device 58 is also input to the voltage shift detection circuit 42. The voltage shift detection circuit 42 in turn outputs a voltage signal that is shifted between a first level and a second level. The shifted voltage signal output by the voltage shift detection circuit 42 tracks the shifting pattern of the voltage output by the voltage shifting device 58. The voltage signal output from the voltage shift detection circuit 42 can be either digital or analog and is input to the microcontroller 34 at a port 34*b*. The microcontroller 34 interprets the sequentially shifted signal as a serial data stream and takes an appropriate action. For example, microcontroller 34 may store the data in the memory device 46, or the microcontroller may perform some action commanded by the data.

Figure 3:
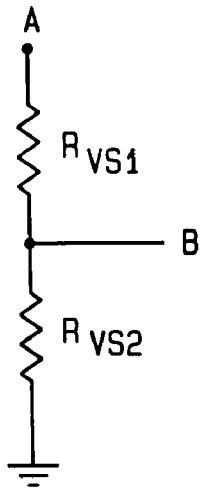
FIG. 3 is a simplified schematic illustrating one preferred embodiment of a voltage shift detection circuit shown in FIG. 2.

The voltage shift detection circuit 42 can be any circuit suitable to modulate the output voltage of the voltage shifting device 58 to levels suitable for input to the microcontroller 34. In one preferred embodiment the voltage shift detection circuit 42 comprises a resistor divider, as illustrated in FIG. 3. In this embodiment the voltage shift detection circuit 42 includes a first voltage shift resistor $R_{vs1}$ and a second voltage shift resistor $R_{vs2}$. The voltage output from voltage shifting device 58 is input at node A. The voltage drop across $R_{vs2}$ is sensed at point B and input to port 34*b* of the microcontroller 34. For example, if $R_{vs1}$ is 62K ohms, $R_{vs2}$ is 10K ohms and the output voltage of the voltage shifting device 58 is shifted between 25V and 7V, the signal at node B will shift between 3.5V and 0.5V. Thus, the voltage signal output from the voltage shift detection circuit 42 is suitable for input to the microcontroller 34. The signal at node B can be read and interpreted by the microcontroller 34 as either a digital signal or an analog signal.

Figure 4:
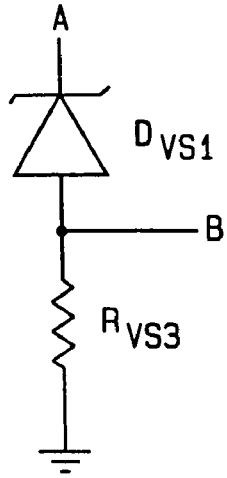
FIG. 4 is a simplified schematic illustrating another preferred embodiment of the voltage shift detection circuit shown in FIG. 2.

FIG. 4 illustrates another preferred embodiment of the voltage shift detection circuit 42 that comprises a voltage subtraction circuit. In this embodiment, the voltage shift detection circuit 42 includes a Zener diode $D_{vs1}$ and a voltage shift resistor $R_{vs3}$. The Zener diode $D_{vs1}$ serves as a voltage subtractor. The voltage output from voltage shifting device 58 is input at node A, then reduced and output to the microcontroller 34 at node B at a voltage level suitable for inputting to the microcontroller 34. For example if $D_{vs1}$ is a 10V Zener diode, $R_{vs3}$ is a simple resistor, and the output voltage of the voltage shifting device 58 is shifted between 13.5V and 10.5V, the signal output at node B will shift between 3.5V and 0.5V. The signal at node B can be read and interpreted as being either analog or digital.

Figure 5:
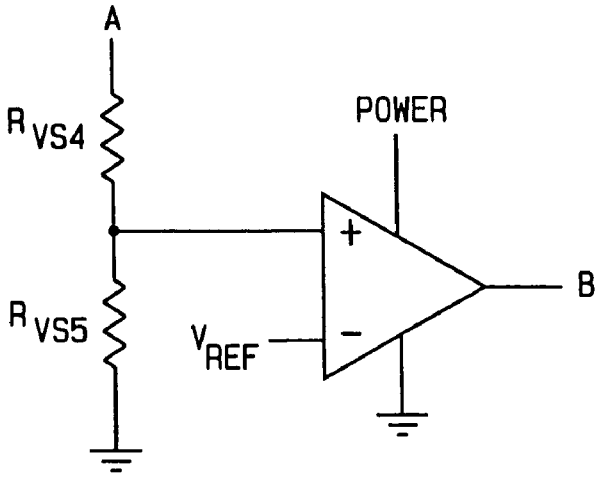
FIG. 5 is a simplified schematic illustrating yet another preferred embodiment of a voltage shift detection circuit shown in FIG. 2.

FIG. 5 illustrates yet another preferred embodiment of the voltage shift detection circuit 42 including a comparator C1 used to output a digital signal to the microcontroller 34 at node B. In this embodiment, in addition to the comparator C1, the voltage shift detection circuit 42 includes a voltage shift resistor $R_{vs4}$ and a voltage shift resistor $R_{vs5}$. The comparator C1 has a fixed voltage reference $V_{ref}$ on its inverting input and its non-inverting input is connected between the and voltage shift resistors $R_{vs4}$ and $R_{vs5}$. The voltage signal output from the comparator C1 shifts between a logic high level signal and a logic low level signal in correlation with the sequential shifting pattern of the voltage output from the voltage shifting device 58. For example, if $R_{vs4}$ is 25K ohms, $R_{vs5}$ is 10K ohms, $V_{ref}$ is 2.5V, and the output voltage V1 of the voltage shifting device 58 is 8V, then the signal output at node B will be at a logic low level. However, if the output voltage V2 of the voltage shifting device 58 is 9V or greater, then node B will be at a logic high level. Therefore, the shifting of the voltage output from the voltage shifting device 58 between V1 and V2, e.g. 8V and 9V or greater, creates a corresponding pulse train at node B. This digital signal is read and interpreted by the microcontroller 34 at port 34*b*. In an alternative preferred embodiment, the comparator C1 is not included in the voltage shift detection circuit 42, but rather included in the microcontroller 34.

In another preferred embodiment, system 10 is adapted for unidirectional communication from the microcontroller 34 to the data reader 66. In this embodiment, once operation of the microcontroller 34 is enabled, the microcontroller 34 immediately downloads, i.e. transmits, data to the data reader 66 in the same manner as described above.

In yet another preferred embodiment, system 10 is adapted for unidirectional communication from the second communications circuit 30 to the microcontroller 34. In this embodiment, once operation of the microcontroller 34 is enabled, the second communications circuit 30 immediately uploads, i.e. transmits, data to the microcontroller 34 in the same manner as described above.

While unidirectional communication is within the scope of the present invention, it is anticipated that bi-directional communication will likely be the more preferred implementation. Bi-directional communication enables important programming of the microcontroller 34 to be readily accomplished, as well as allowing tool performance information to be downloaded from the tool 14.

Figure 6:
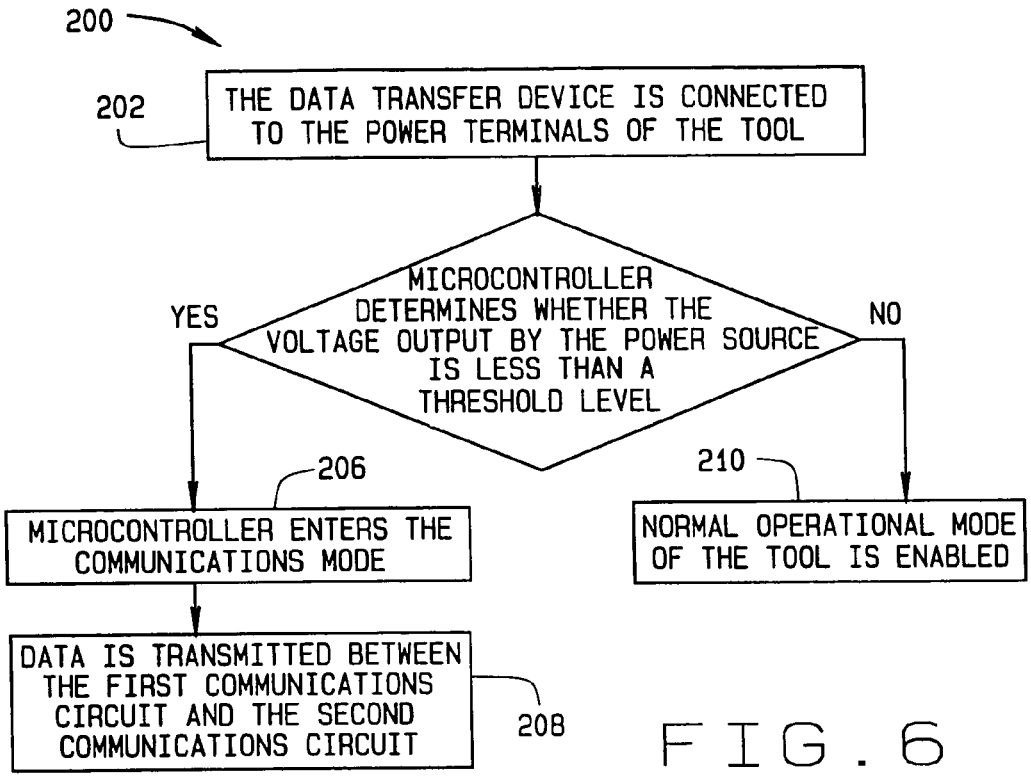
FIG. 6 is a flow chart illustrating another preferred embodiment of initiating communications mode of the tool.

FIG. 6 is a flow chart 200 illustrating another preferred implementation for initiating the communications mode of the tool 14. Initially, the data transfer device 18 is connected to the power terminals 22*a* and 22*b*, as indicated at 202. The microcontroller 34 then determines whether the voltage output by power source 54 is greater than or less than a predetermined threshold voltage, for example 6.5 volts, as indicated at 204. If the output of the power source 54 is less than the threshold level then the microcontroller 34 enters the communications mode, as indicated at 206. The communications mode can be any of the bidirectional or unidirectional communications modes described above. Once in the communications mode, data is transmitted between the first communications circuit 26 and the second communications circuit 30 in the manner described above, as indicated at 208. If the output of the power source 54 is greater than or equal to the threshold level, then the microcontroller 34 does not enter communications mode and a normal operational mode of the tool 14 is enabled, as indicated at 210.

Figure 7:
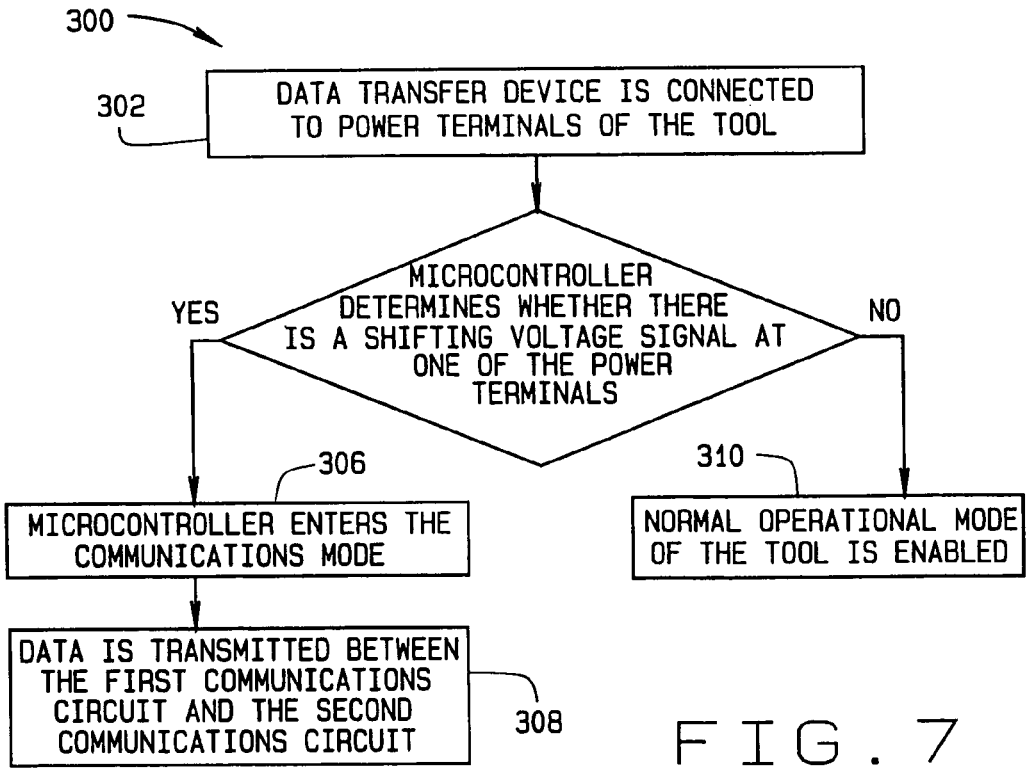
FIG. 7 is a flow chart illustrating yet another preferred embodiment of initiating communications mode of the tool.

FIG. 7 is a flow chart 300 illustrating another preferred implementation for initiating the communications mode of the tool 14. Initially, the data transfer device 18 is connected to the power terminals 22*a* and 22*b*, as indicated at 302. The microcontroller 34 then determines whether there is a voltage shifting signal at terminal 22*a*, as indicated at 304. That is, the microcontroller 34 determines whether there is a substantially steady voltage signal, e.g. DC signal, or a shifting voltage signal, e.g. AC signal, at terminal 22*a* when the data transfer device 18 is connected to power terminals 22*a* and 22*b*. If the signal at terminal 22*a* is a shifting signal, then the microcontroller 34 enters the communications mode, as indicated at 306. The communications mode can be any of the bidirectional or unidirectional communications modes described above. Once in the communications mode, data is transmitted between the first communications circuit 26 and the second communications circuit 30 in the manner described above, as indicated at 308. If the signal at terminal 22*a* is a steady signal, then the microcontroller 34 does not enter communications mode and a normal operational mode of the tool 14 is enabled, as indicated at 310.

In still another preferred embodiment, wherein the data transfer device 18 is a removable, portable battery pack, the system 10 transfers data immediately upon connection of the battery pack to the power terminals 22*a* and 22*b*. For example, immediately upon insertion of the battery pack into the tool 14, the microcontroller 34 downloads data to the second communications circuit 30. Similarly, data from the second communications circuit 30 can be immediately uploaded to the first communications circuit 26 upon insertion of the battery pack into the tool 14. As a further example, bidirectional communication can also occur immediately upon connection of the data transfer device 18, i.e. the battery pack including the second communications circuit 30, to the power terminals 22*a* and 22*b*. Bidirectional communications can occur by immediately downloading data to the data reader 66 and then uploading data to the microcontroller 34 immediately upon completion of the download, or vice versa. In this embodiment the battery pack not only immediately enables the microcontroller 34, but also immediately provides operational power to the tool 14. Therefore, in any of the communications modes, the microcontroller 34 will suspend or stop the transfer of data if operation of the tool 14 is attempted.

The system 10 thus provides a means to provide unidirectional or bi-directional communications with an electronic component located within the housing of the power tool without requiring disassembly of the tool. As a result, important tool programming can be accomplished quickly and easily without any disassembly of the tool 14. This significantly simplifies manufacture of the tool 14. Just as importantly, stored tool operation/performance information can quickly and easily be down loaded without any disassembly of the tool 14.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for communicating data between a cordless power tool and a host device, said method comprising:

inserting the host device into a battery pack receptacle of the tool such that the host device is connected to at least one battery terminal of the tool;

entering a tool communications mode; and transmitting data between the power tool and the host device.

2. The method of claim 1, wherein inserting the host device comprises inserting a removable battery pack including a communications circuit into the battery pack receptacle, wherein the battery pack is used to provide power to the tool during both the communications mode and a tool operational mode.

3. The method of claim 1, wherein transmitting data comprises varying at least one of a voltage and a current supplied by the host device to the tool between a first level and a second level to transmit data from the tool to the host device.

4. The method of claim 3, wherein varying a voltage supplied by the host device to the tool comprises sequentially alternating a voltage across a resistor in the tool between a first voltage and a second voltage.

5. The method of claim 4, wherein varying a voltage supplied by the host device to the tool further comprises sequentially alternating a voltage across a resistor in the host device between a first voltage and a second voltage as a result of sequentially alternating the voltage across the tool resistor.

6. The method of claim 5, wherein varying a voltage supplied by the host device to the tool further comprises resolving the sequentially alternating voltage across the host device resistor into digital signals representative of the data transmitted from the tool to the host device.

7. The method of claim 6, wherein varying a voltage supplied by the host device to the tool further comprises storing the data transmitted from the tool to the host device in a data reader.

8. The method of claim 1, wherein transmitting data comprises shifting a voltage signal to a microcontroller of the tool between a first voltage and a second voltage to transmit data from the host device to the tool.

9. The method of claim 8, wherein shifting a voltage signal to a microcontroller comprises sequentially switching a voltage supplied from the host device to the tool between a first voltage and a second voltage.

10. The method of claim 9, wherein shifting a voltage signal to a microcontroller further comprises resolving the sequentially switching voltage supplied from the host device to the tool into digital signals representative of the data transmitted from the host device to the tool.

11. The method of claim 10, wherein shifting a voltage signal to a microcontroller further comprises:

inputting the digital signals to the microcontroller; and storing the transmitted data in a tool memory device.

12. The method of claim 1, wherein transmitting data comprises:

varying at least one of a voltage and a current supplied by the host device to the tool between a first level and a second level to transmit data from the tool to the host device; and shifting a voltage signal to a microcontroller of the tool between a first voltage and a second voltage to transmit data from the host device to the tool.

13. The method of claim 1, wherein entering a communications mode comprises determining whether a power level provided by the host device to the tool is less than a predetermined threshold.

14. The method of claim 13, wherein entering a communications mode further comprises entering the communications mode if the power level is less than the threshold.

15. The method of claim 1, wherein inserting the host device comprises inserting a connector of the host device into the battery pack receptacle, wherein the connector is shaped substantially similar to the removable battery pack and communicatively linked to a communications circuit of the host device.

16. A method of downloading data from a cordless power tool to a data receiving device, said method comprising:

removing a battery pack from the power tool;

connecting the data receiving device to the power tool in substantially the same manner as the battery pack is connected in the power tool, thereby connecting the data receiving device to at least one power terminal of the power tool used for connecting the tool to the battery pack during operation of the tool;

sequentially alternating at least one of a voltage and a current supplied by the data receiving device to the tool between a first level and a second level to transmit data from the tool to the data receiving device; and storing the data transmitted from the tool to the data receiving device in a data reader.

17. The method of claim 16, wherein sequentially alternating a voltage supplied by the data receiving device to the tool comprises sequentially alternating a voltage across a resistor in the tool between a first voltage and a second voltage.

18. The method of claim 16, wherein sequentially alternating a voltage supplied by the data receiving device to the tool further comprises sequentially alternating a voltage across a resistor in the data receiving device between a first voltage and a second voltage as a result of sequentially alternating the voltage across the tool resistor.

19. The method of claim 18, wherein sequentially alternating a voltage supplied by the data receiving device to the tool further comprises resolving the sequentially alternating voltage across the data receiving device resistor into digital signals representative of the data transmitted from the tool to the data receiving device.

20. The method of claim 19, wherein storing the data transmitted from the tool to the data receiving device comprises:

transmitting the digital signals to the data reader; and storing the data in a memory device of the data reader.

21. A method of uploading data from a programming device to a cordless power tool, said method comprising:

removing a battery pack from the power tool;

connecting the programming device to the power tool in substantially the same manner as the battery pack is connected in the power tool, thereby connecting the programming device to at least one power terminal of the tool used for connecting the tool to a power supply during operation of the tool;

sequentially alternating a voltage signal to a microcontroller of the tool between a first level and a second level to transmit data from the programming device to the tool; and storing the data transmitted from the programming device to the tool in a memory device of the tool.

22. The method of claim 21, wherein sequentially alternating a voltage signal to a microcontroller comprises sequentially switching a voltage supplied from the programming device to the tool between a first voltage and a second voltage.

23. The method of claim 22, wherein sequentially alternating a voltage signal to a microcontroller further comprises resolving the sequentially switching voltage supplied from the programming device to the tool into digital signals representative of the data transmitted from the programming device to the tool.

24. The method of claim 23, wherein storing the data transmitted from the programming device to the tool comprises inputting the digital signals to the microcontroller.

25. A system for communicating data to and from a cordless power tool, said system comprising:

a host device adapted to be interchangeable with a removable battery pack of the tool such that the host device is connected to at least one power terminal of the tool, wherein the battery pack is used to power the power tool during operation of the power tool;

a first communications circuit included in the tool adapted to vary a voltage supplied by the host device to the tool between a first level and a second level to transmit data from the tool to the host device; and a second communications circuit included in the host device adapted to vary a voltage signal to a microcontroller of the tool between a first level and a second level to transmit data from the host device to the tool.

26. The system of claim 25, wherein, the first communications circuit includes a first resistor and microcontroller adapted to sequentially alternate a voltage across the first resistor between a first voltage and a second voltage.

27. The system of claim 26, wherein the second communications circuit includes a second resistor, wherein a voltage across the second resistor is sequentially alternated between a first voltage and a second voltage as a result of the sequentially alternating voltage across the first resistor.

28. The system of claim 27, wherein the second communications circuit further includes a differential circuit adapted to resolve the sequentially alternating voltage across the second resistor into digital signals representative of the data transmitted from the tool to the host device.

29. The system of claim 28, wherein the second communications circuit further includes a memory device and a data reader adapted to receive the digital signals and store the data in the memory device.

30. The system of claim 28, wherein the second communications circuit is further adapted to connect to a remote computer device adapted to receive the digital signals and store the data.

31. The system of claim 25, wherein the second communications circuit includes a voltage shifting device adapted to sequentially switch a voltage supplied from the second communications circuit to the first communications circuit between a first voltage and a second voltage.

32. The system of claim 31, wherein the first communications circuit includes a voltage shift detection circuit adapted to resolve the sequentially switching voltage supplied from the second communications circuit to the first communications circuit into digital signals representative of the data transmitted from the host device to the tool.

33. The system of claim 32, wherein the first communications circuit further includes a memory device, wherein the microcontroller is adapted to receive the digital signals and store the data represented thereby in the memory device.

34. The system of claim 26, wherein the microcontroller is further adapted to determine if a power supplied by the second communications circuit to the first communications circuit is less than a predetermined threshold level.

35. The system of claim 34, wherein the microcontroller is further adapted to enter a communications mode if the power level is less than the predetermined level.

36. The system of claim 25, wherein the host device comprises a removable battery pack that includes the second communications circuit.

37. The system of claim 25, wherein the host device comprises a connector communicatively linked to a computer based device including a communications circuit, the connector shaped substantially similar to the battery pack.

38. A cordless power tool adapted to communicate with a data transfer device, said tool comprising:

a removable battery pack used to power the tool when the tool is in an operation mode;

a battery pack receptacle adapted to interchangeably retain either the battery pack or a data transfer device;

at least one power terminal within the receptacle adapted to connect to the battery pack when the tool is the operation mode and to the data transfer device when the tool is in a communications mode; and a first communications circuit housed within the power tool and connected to the power terminal, the first communications circuit adapted to communicate with the data transfer device over the power terminal.

39. The tool of claim 38, wherein the first communications circuit is further adapted to sequentially vary a voltage across a resistor in the data transfer device between a first level and a second level to transmit data from the tool to the data transfer device.

40. The tool of claim 39, wherein, the first communications circuit includes a microcontroller adapted to sequentially alternate a voltage across a resistor in the first communications circuit between a first voltage and a second voltage, thereby sequentially varying the voltage across the resistor in the data transfer device to transmit the data from the tool to the data transfer device.

41. The tool of claim 40, wherein the first communications circuit further includes a memory device, and wherein the microcontroller is adapted to receive the digital signals and store the data represented thereby in the memory device.

42. The tool of claim 40, wherein the microcontroller is further adapted to determine if a power supplied by a second communications circuit to the first communications circuit is less than a predetermined threshold level, the second communications circuit included in the host device.

43. The tool of claim 42, wherein the microcontroller is further adapted to enter a communications mode if the power level is less than the predetermined level.

44. The tool of claim 38, wherein the first communications circuit is further adapted to receive a voltage from the data transfer device that is sequentially shifted between a first voltage and a second voltage to transmit data from the data transfer device to the tool.

45. The tool of claim 44, wherein the first communications circuit further includes a voltage shift detection circuit adapted to resolve the sequentially shifted voltage received from the data transfer device into digital signals representative of the data transmitted from the host device to the tool.

46. The tool of claim 38, wherein the host device comprises a removable battery pack that includes a second communications circuit.

47. The tool of claim 38, wherein the host device comprises a connector communicatively linked to a computer based device including a communications circuit, the connector shaped substantially similar to the battery pack.

48. The tool of claim 38, wherein the communications circuit is further adapted to:

sequentially vary a voltage across a resistor in the data transfer device between a first level and a second level to transmit data from the tool to the data transfer device; and receive a voltage from the data transfer device that is sequentially shifted between a first voltage and a second voltage to transmit data from the data transfer device to the tool.

49. A method for communicating data between a cordless power tool and a host device, said method comprising:

inserting the host device into a battery pack receptacle of the power tool such that the host device is connected to at least one battery terminal of the tool, wherein the battery pack receptacle is adapted to retain a removable battery pack during a tool operational mode;

determining whether a power level provided by the host device to the tool is less than a predetermined threshold;

entering a communications mode if the power level is less than the threshold; and transmitting data between the power tool and the host device upon entering the communications mode.

50. The method of claim 49, wherein inserting the host device comprises inserting a removable battery pack including a communications circuit into the battery pack receptacle, wherein the battery pack is used to provide power to the tool during the tool operation mode.

51. The method of claim 49, wherein inserting the host device comprises inserting a connector of the host device into the battery pack receptacle, wherein the connector is shaped substantially similar to the removable battery pack and communicatively linked to a communications circuit of the host device.

52. The method of claim 49, wherein transmitting data comprises immediately downloading data from the tool to the host device upon entering the communications mode.

53. The method of claim 49, wherein transmitting data comprises immediately uploading data from the host device to the tool upon entering the communications mode.

54. The method of claim 49, wherein transmitting data comprises immediately exchanging bidirectional data transmissions between the host device and the tool upon entering the communications mode.

55. The method of claim 49, wherein transmitting data comprises suspending the transmission of data if the operational mode of the tool is activated.

56. A method for communicating data between a cordless power tool and a host device, where the cordless power tool has a receptacle with a power terminal connection, a removable battery pack adapted to attach to the receptacle to make electrical connection with the power terminal connection, and an internal module in communication with the power terminal connection, the method comprising:

removing the battery pack from the receptacle of the tool;

coupling at least a portion of a host device to the power terminal connection of the tool; and using the host device to facilitate transmission of information between the host device and the module in the tool.

57. The method of claim 56, wherein coupling a portion of the host device to the power terminal connection comprises inserting the host device into the receptacle, wherein the host device is shaped substantially similar to the battery pack.

58. The method of claim 57, wherein inserting the host device comprises inserting a removable battery pack including a communications circuit into the battery pack receptacle, wherein the battery pack is used to provide power to the tool during the tool operation mode.

59. The method of claim 58, wherein inserting the host device comprises inserting a connector of the host device into the battery pack receptacle, wherein the connector is shaped substantially similar to the removable battery pack and communicatively linked to a communications circuit of the host device.

* * * * *